US005353734A

United States Patent [19]

Tani

[11] Patent Number: 5,353,734

[45] Date of Patent: Oct. 11, 1994

[54] SEAT FOR WATERCRAFT

[75] Inventor: Satoshi Tani, Iwata, Japan

[73] Assignee: Yamaha Hatsudoki Kabushiki Kaisha, Iwata, Japan

[21] Appl. No.: 927,054

[22] Filed: Aug. 5, 1992

[30] Foreign Application Priority Data

Aug. 8, 1991 [JP] Japan ..... 3-199094
Jan. 27, 1992 [JP] Japan ..... 4-012341

[51] Int. Cl.[5] ..... B63H 11/00
[52] U.S. Cl. ..... 114/363; 297/199
[58] Field of Search ..... 114/343, 363, 270; 440/38; 297/195, 199, 200, 452, DIG. 1, DIG. 3, DIG. 8

[56] References Cited

U.S. PATENT DOCUMENTS 2,664,241 12/1953 Sunday ..... 114/363
4,688,509 8/1987 Nishida ..... 114/363
4,854,261 8/1989 Goldsmith ..... 114/363
5,197,406 3/1993 Rabal et al. ..... 114/363
5,209,178 5/1993 Rowe ..... 114/363

FOREIGN PATENT DOCUMENTS 53-24799 6/1976 Japan .

*Primary Examiner*—Stephen P. Avila
*Attorney, Agent, or Firm*—Knobbe, Martens, Olson & Bear

[57] ABSTRACT

A number of embodiments of seat assemblies for a watercraft wherein the seat includes a cushion comprised of at least in part an open celled foam that is covered on its lower side by a bottom plate and on its upper side by a skin that is sealingly engaged also with the bottom plate. At least one air flow opening is formed in the bottom through which air may be expelled upon compression of the cushioning material and returned upon expansion of the cushioning material. This opening communicates with a hermetically sealed cavity so that water cannot enter the cushion along with the air flowing through the opening. In some embodiments, the openings discharge into a flexible bag which offers a further hermetic seal for the openings and which is contained in the cavity.

19 Claims, 8 Drawing Sheets

SEAT FOR WATERCRAFT

BACKGROUND OF THE INVENTION

This invention relates a seat for a watercraft and more particularly to an improved seat cushion construction.

Many types of watercraft are provided with seats which include a seat cushion of a foam material and a surrounding protective covering. In order to provide a comfortable seat cushion, it is desirable to employ a material such as an open celled or partially open celled foam for the cushioning material. If, however, a water type covering is provided for the seat cushion, then the expulsion of air from the cushion when a rider sits upon the seat can cause rupturing of the water type covering.

It has, therefore, been proposed to provide a foam cushion which is covered on its upper sides by a water type covering but which has an perforate lower layer so as to permit air to be expelled when a rider sits on the seat and re-enter the cushion when he leaves the seat. However, due to the fact that the watercraft operates in an area where there is a considerable amount of water, water may enter the cushion when it expands. This is undesirable for a great variety of reasons.

In order to avoid these problems, it has been proposed to provide an air discharge opening in the lower portion of the seat cushion that communicates with a flexible bag to accommodate the air flow into and out of the foam cushion material when passengers sit on the cushion or leave the cushion and to provide a hermetic seal for the foam material. However, these devices require a fairly substantial volume beneath the seat, unless the cushion is made so thin as to be uncomfortable. Hence, there is a substantial space wastage with the prior art solutions to this problem.

It is, therefore, a principal object of this invention to provide an improved seat structure that can be used in a water vehicle and which will be hermetically sealed and nevertheless permit air flow into and out of the foam cushion material without having water enter the cushion material.

It is a further object of this invention to provide an improved and compact arrangement for hermetically sealing a cushion for a water vehicle which has a compact construction.

It is a further object of this invention to provide a combined seat arrangement and storage compartment arrangement for a water vehicle which will permit the seat cushion to breath when passengers sit on it while at the same time avoiding the intrusion of water when the passenger leaves the seat cushion.

SUMMARY OF THE INVENTION

This invention is adapted to be embodied in a seat for a watercraft having a hull. An open celled foam cushion is provided with a generally rigid bottom plate that extends across its lower surface. A generally water impervious skin is sealingly engaged around the periphery of the bottom plate and covering the remainder of the cushion. Means define a cavity beneath the seat and a hermetic seal is formed between the periphery of the cavity and the bottom plate. At least one air flow opening through which air may flow upon compression and expansion of the cushion is formed in the bottom plate.

DETAILED DESCRIPTION OF THE PREFERRED EMBODIMENTS OF THE INVENTION

Figure 1:
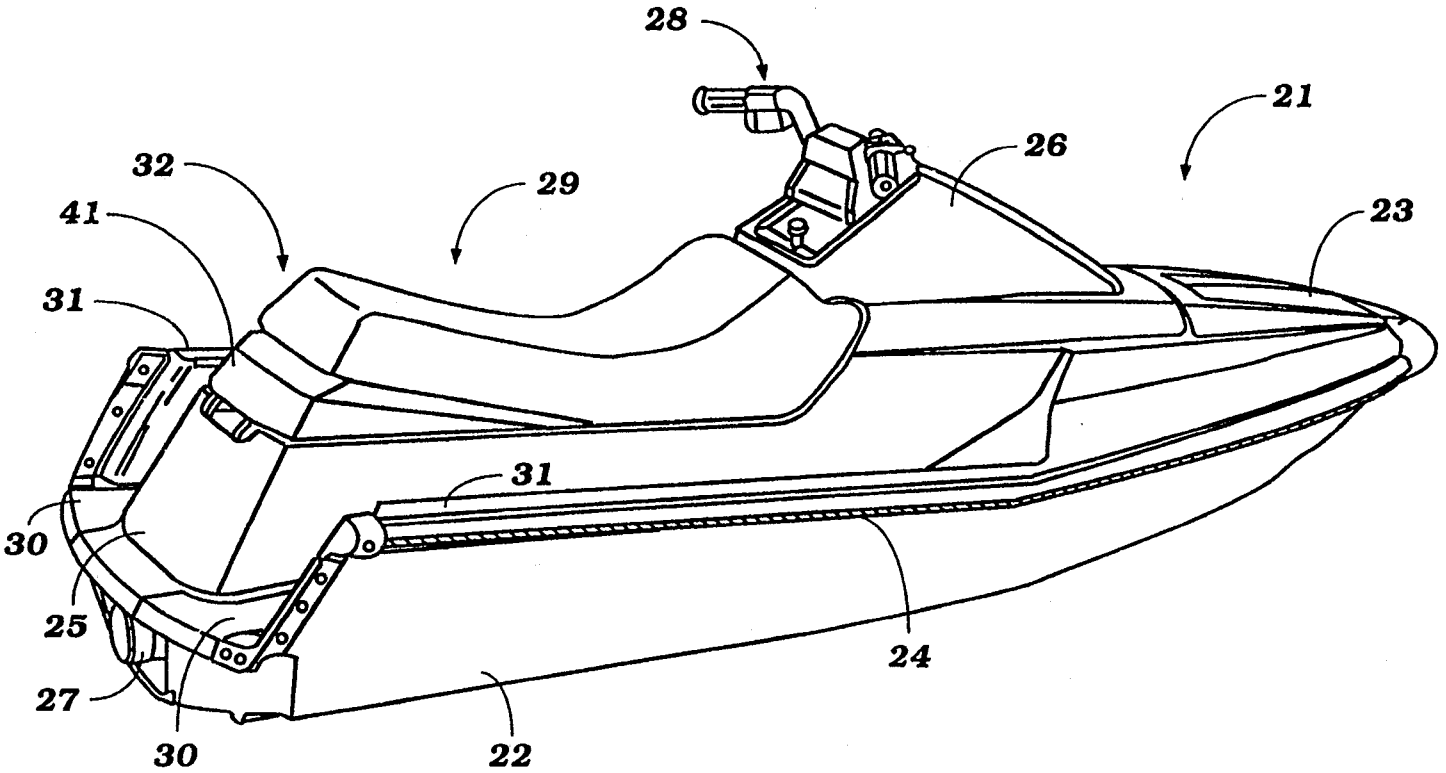
FIG. 1 is a perspective view taken from the rear and side of a water vehicle having a seat constructed in accordance with an embodiment of the invention.
Figure 2:
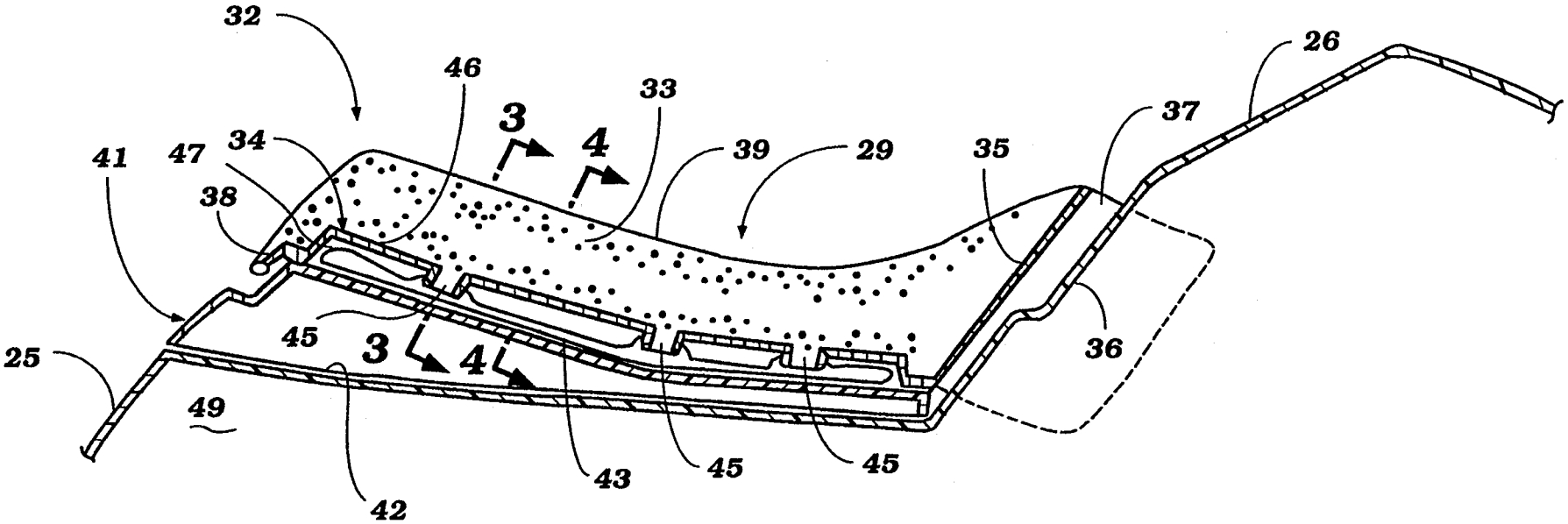
FIG. 2 is a longitudinal cross sectional view of the seat construction, taken on a larger scale.

Referring now in detail to the drawings and particularly to the embodiment of FIGS. 1 through 5 and initially primarily to FIG. 1, a small watercraft having a seat constructed in accordance with an embodiment of the invention is identified generally by the reference numeral 21. The small watercraft 21 in the illustrated embodiment is of the jet propelled type and includes a hull having a lower hull portion 22 and an upper deck portion 23 that are secured together along their peripheral edges by a flange 24. The hull portions 22 and 23 are formed from a suitable material such as a molded fiberglass reinforced resin.

The watercraft 21 is powered by a jet propulsion unit, which is shown in some of the figures illustrating other embodiments which is mounted in a tunnel formed beneath an upwardly extending portion 25 of the deck. An engine is mounted in a forward compartment, under a hatch cover 26 and drives the jet propulsion unit in a known manner.

The jet propulsion unit has a steering nozzle 27 which is supported for steering about a vertically extending steering axis and which is steered by a handlebar assembly 28 mounted on the hatch cover 26 in a known manner.

The raised portion of the deck 25 to the rear of the hatch cover 26 accommodates a seat assembly, indicated generally by the reference numeral 29, and which is constructed in accordance with an embodiment of the invention. The seat assembly 29 is adapted to accommodate an operator and a passenger seated in straddle, tandem fashion. To this end, there is provided a pair of raised gunnels 31 which are spaced outwardly from the raised deck portion 25 and which define a foot area 30 therebetween on which the operator and passenger may place their feet. It will be noted that the foot areas 30 open through the rear of the hull so that water may freely drain from them and so as to accommodate entry on to the watercraft 21 from the rear.

The seat assembly 29 will now be described in more detail by reference to the remaining figures of this embodiment (2 through 5). The seat assembly 29 is comprised of a cushion portion, indicated generally by the reference numeral 32 which includes a cushioning material 33 founded from an open cell relatively soft plastic foam such as a urethane foam.

This foam 33 is bonded or otherwise adhered to a bottom plate, indicated generally by the reference numeral 34 which has a lower portion that extends along the bottom of the foam material 33 but which is recessed into this bottom so as to provide a cavity, which will be hereinafter described. The bottom plate 34 also has a forward portion 35 which extends upwardly and parallel to a wall 36 of the deck portion 23 positioned to the rear of the hatch cover 26. A pair of wing like members 37 extend forwardly from the front plate portion 35 and extend along opposite sides of the hatch cover 26 so that the operator may grip the hatch cover and forward portion 36 of the deck between his knees for stability purposes. A downwardly extending flange 38 is also formed at the peripheral edge of the lower plate assembly 34 and is covered by a downwardly extending portion of the foam cushion material 33.

A waterproof covering 39 extends around and sealingly engages the otherwise exposed portion of the cushion 33 and is secured by bonding or the like to the lower plate flange 38 so as to provide a hermetic seal around the cushioning material 33. The covering 39 may be formed from a relatively flexible material such as vinyl or the like.

A base member, indicated generally by the reference numeral 41 is interposed between the seat cushion lower plate portion 34 and a horizontally extending surface 42 of the deck portion 23 of the watercraft hull so as to support the cushion 32 on the hull and to adjust the angle of the seat assembly 29 relative to the hull. The support portion 41 may, like the remainder of the hull, be formed from a molded fiberglassed reinforced resin.

Being an open celled foam, the cushion material 33 will, when compressed when riders sit upon it, tend to cause the air from the open cells to be expelled to the atmosphere. Unless this air is permitted to expel, the seat 29 will feel quite rigid to the riders.

To avoid this and to provide a comfortable seat while, at the same time, avoid the intrusion of water along with air when the cushion 33 then again expands, a flexible bag, indicated generally by the reference numeral 43 is provided to receive the air upon compression and return the air upon expansion while precluding the entry of water into the cushion 33. The bag 43 is formed with a plurality of nipple portions 44 which are received upon duct outlet openings 45 formed in a depressed part 46 of the lower plate 34. This provides a recessed area, indicated generally by the reference numeral 47 which is formed between the portion 46 and the upper part of the seat support 41. Clamps 48 are provided so as to affix the bag 43 to each of the outlet openings 45 and provide a hermetic seal.

When operators sit on the seat 29, air will be expelled and the bag 43 will expand. When the cushion material 33 again expands, the voids in the cells will be filled from the air that had been previously forced into the bag 43 and hence the hermetic seal will be maintained without adversely effecting the cushioning of the seat 29 and specifically the cushion material 33.

Because the void 47 is actually formed in the lower portion of the seat 29, the provision of the bag 43 will not require any external space and it is possible to provide a storage compartment 49 beneath the raised deck portion 25 which can be accessed through a suitable access opening (not shown).

Figure 3:
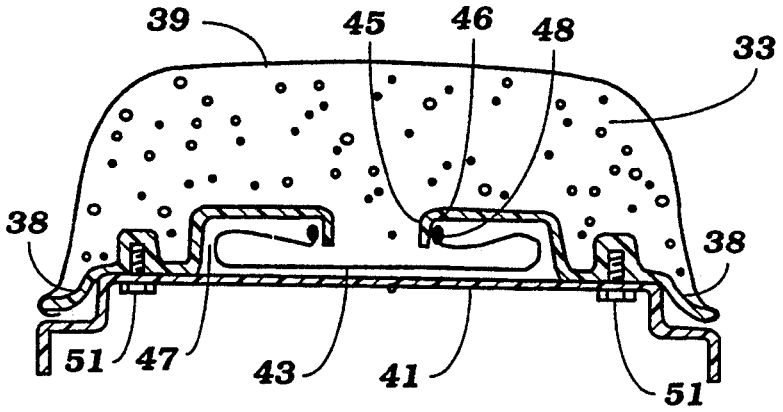
FIG. 3 is a cross sectional view taken along the line 3—3 of FIG. 2.
Figure 4:
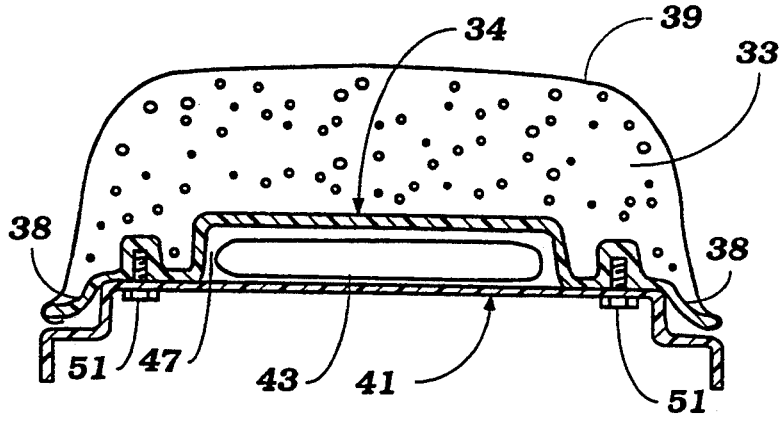
FIG. 4 is a cross sectional view taken along the line 4—4 of the FIG. 2.
Figure 5:
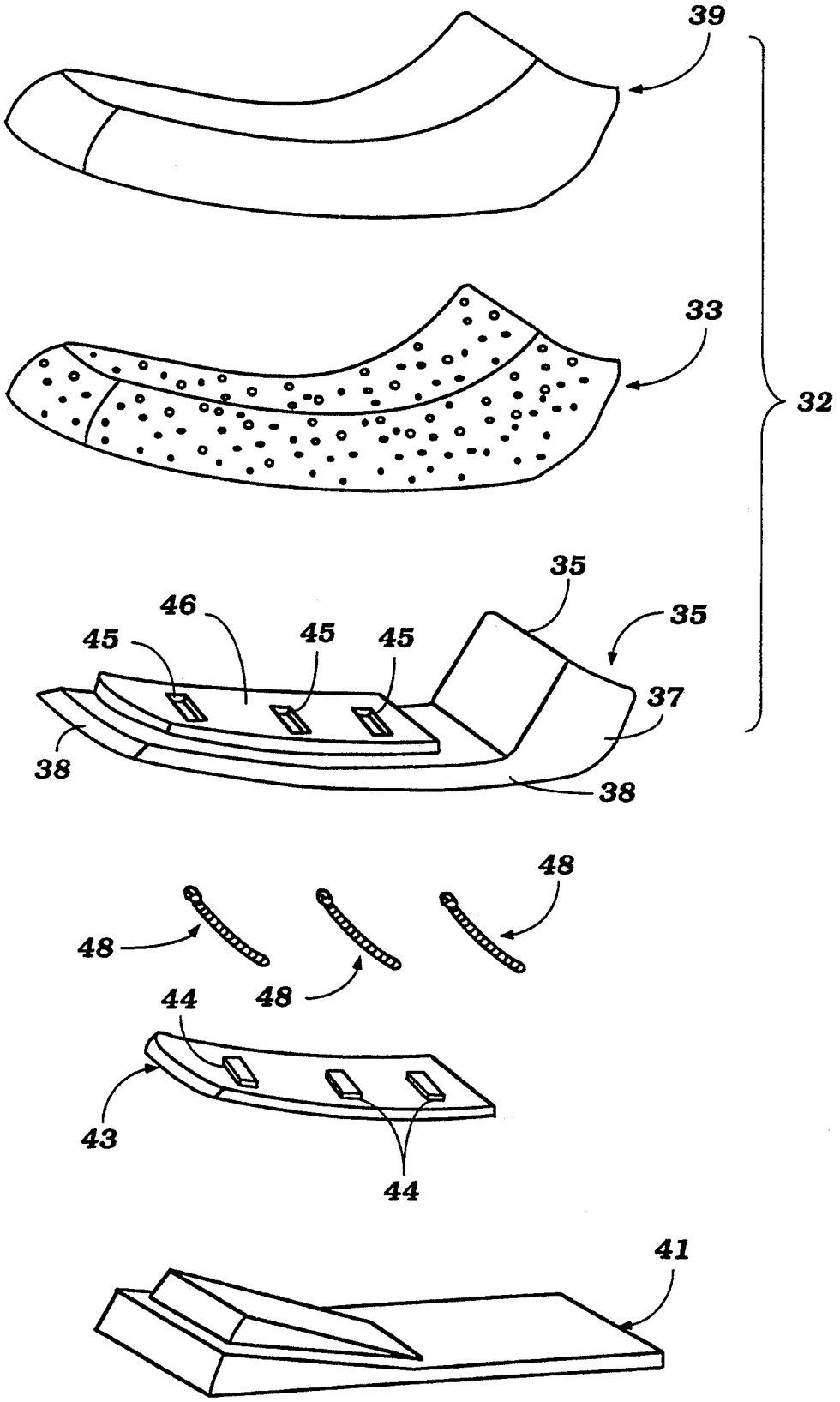
FIG. 5 is an exploded perspective view of the seat.

As may be seen in FIGS. 3 and 4, the seat portion 32 is affixed to the mounting portion 41 by means of a plurality of threaded fasteners 51 and a suitable sealing gasket (not illustrated) may be provided around this interface so as to provide a hermetic seal for the cavity 47 which will further assist in the prevention of water intrusion. Of course, such a seal can be deleted since the bag 43 in effect completes the hermetic seal for the seat cushion 32 and the cushioning material 33.

Figure 6:
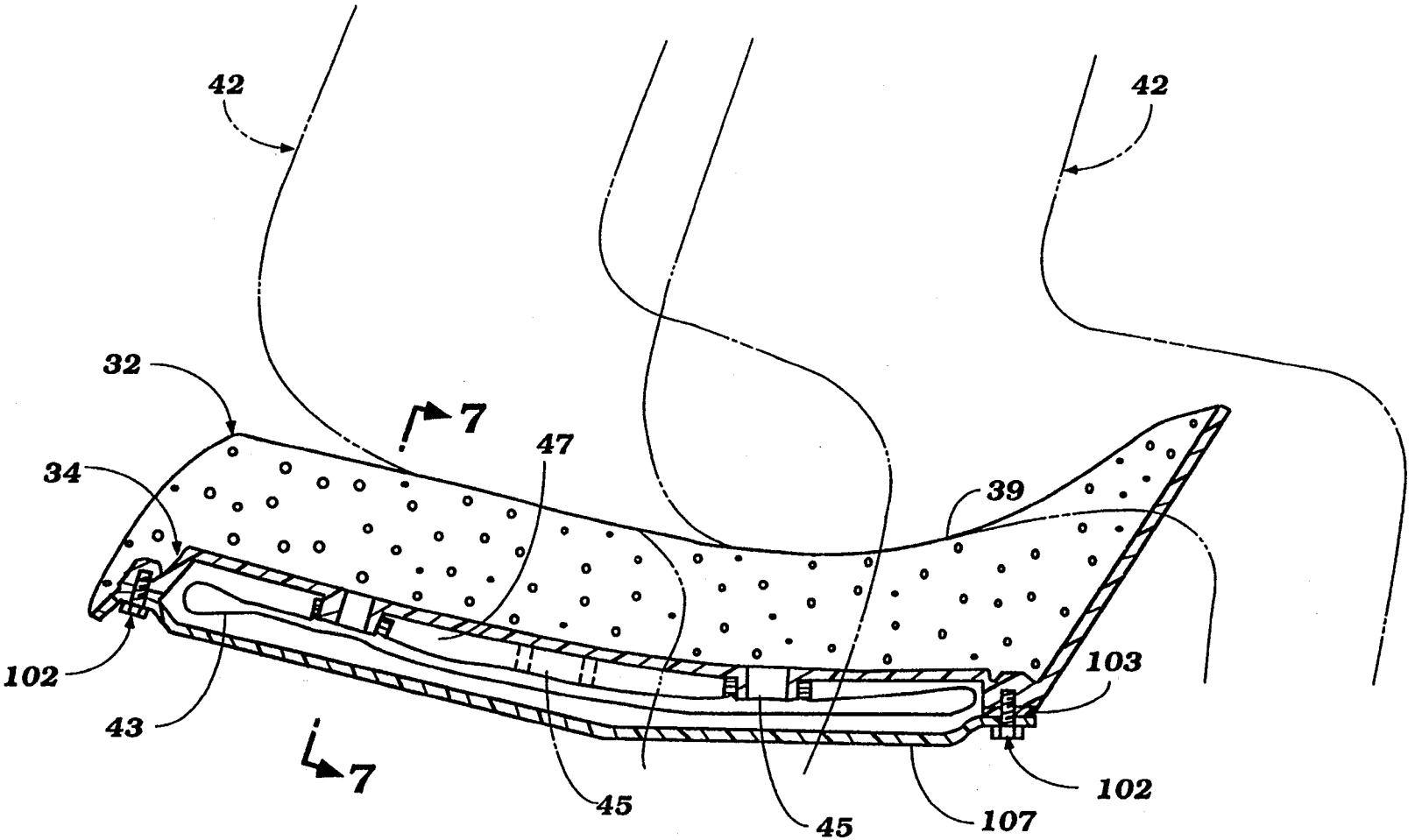
FIG. 6 is a cross sectional view, in part similar to FIG. 2, and shows a further embodiment of the invention.
Figure 7:
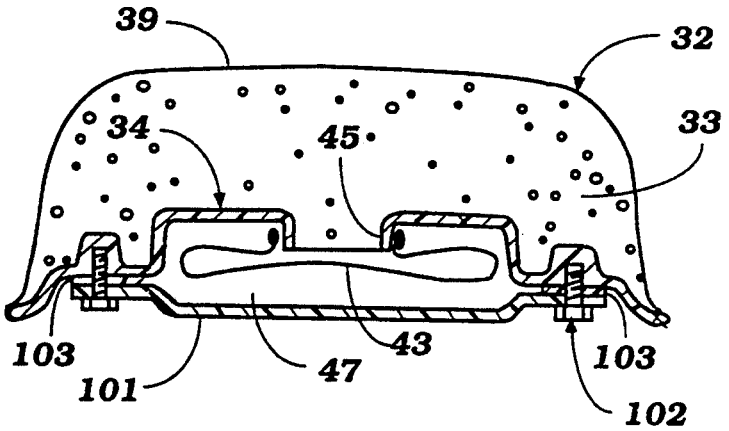
FIG. 7 is a cross sectional view taken along the line 7—7 of FIG. 6.

In the embodiment thus far described, the sealed area 47 has been provided between the bottom plate 34 and the seat base 41. FIGS. 6 and 7 show another embodiment of the invention wherein the seat base 41 does not provide the sealed area 47 but rather a closure plate 101 is affixed to the seat bottom plate 34 by threaded fasteners 102 with a sealing gasket 103 being interposed therebetween. Thus, like the previously described embodiment, this embodiment provides a hermetically sealed area in which the air may expand and contract which is further sealed by the bag 43.

Figure 8:
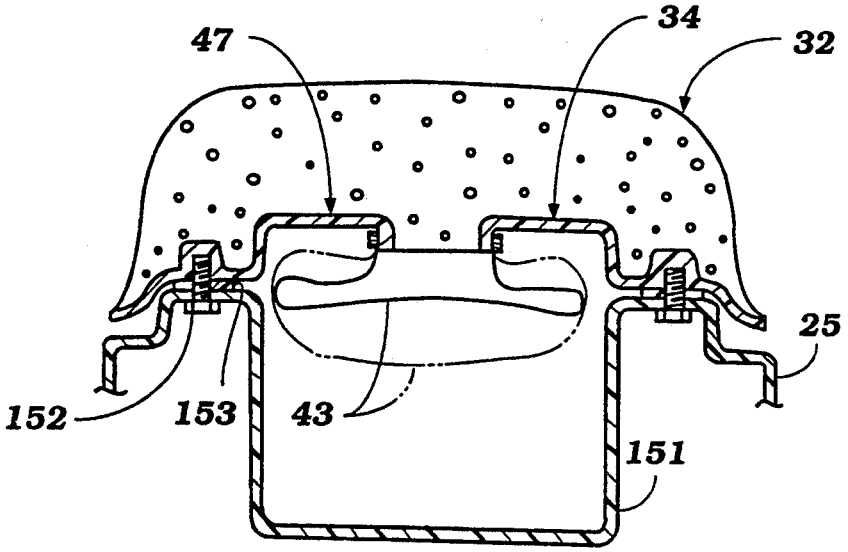
FIG. 8 is a cross sectional view, in part similar to FIG. 7, and shows another embodiment of the invention.

In the embodiments as thus far described, the hermetically sealed area 47 in which the bag 43 has been provided is of such a volume as to accommodate nothing more than the full expansion of the bag 43 when the cushion 33 is fully compressed. However, it is possible to make a larger hermetically sealed area and this area cannot only accommodate the bag 43 and its expansion but also can provide a storage compartment which may be accessed. Such an embodiment is shown in FIG. 8 wherein the raised portion 25 of the deck 23 of the hull is formed with a depressed central area 151 to which the seat 32 is affixed by threaded fasteners 152 with a sealing gasket 153 being interposed therebetween. The fact that the compartment 47 may be accessed for other storage will not adversely effect the water sealing capabilities since, in this embodiment, the bag 43 is also provided for receiving the expanding air and for returning it to the cushion material 33.

Figure 9:
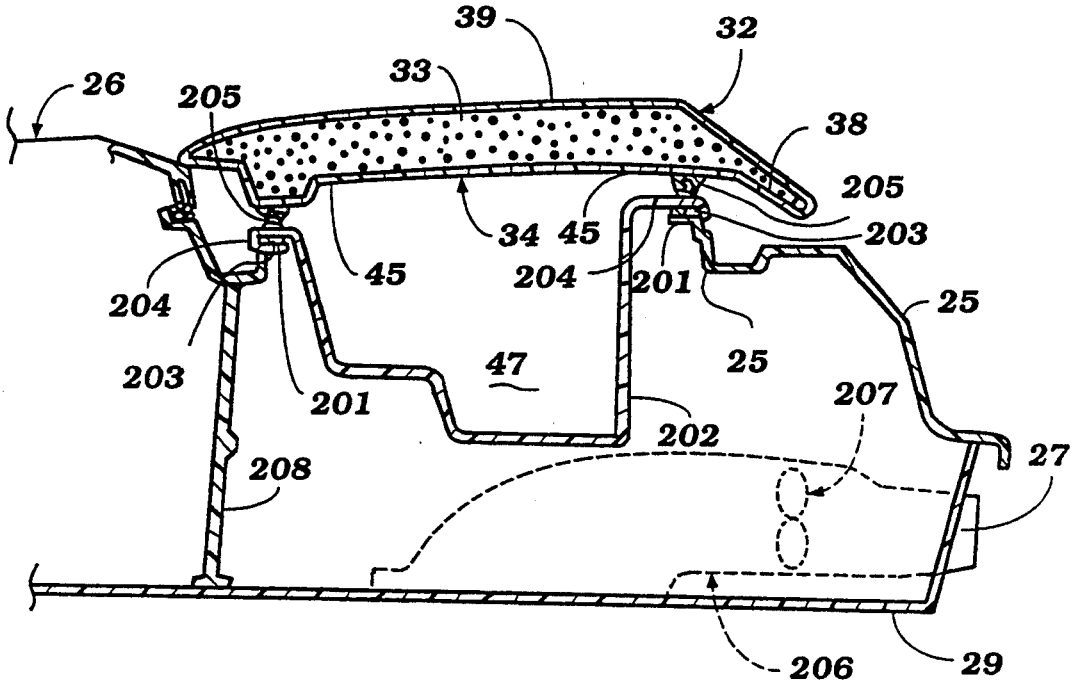
FIG. 9 is a cross sectional view, in part similar to FIGS. 2 and 6 but taken in the opposite direction and shows yet another embodiment of the invention.
Figure 10:
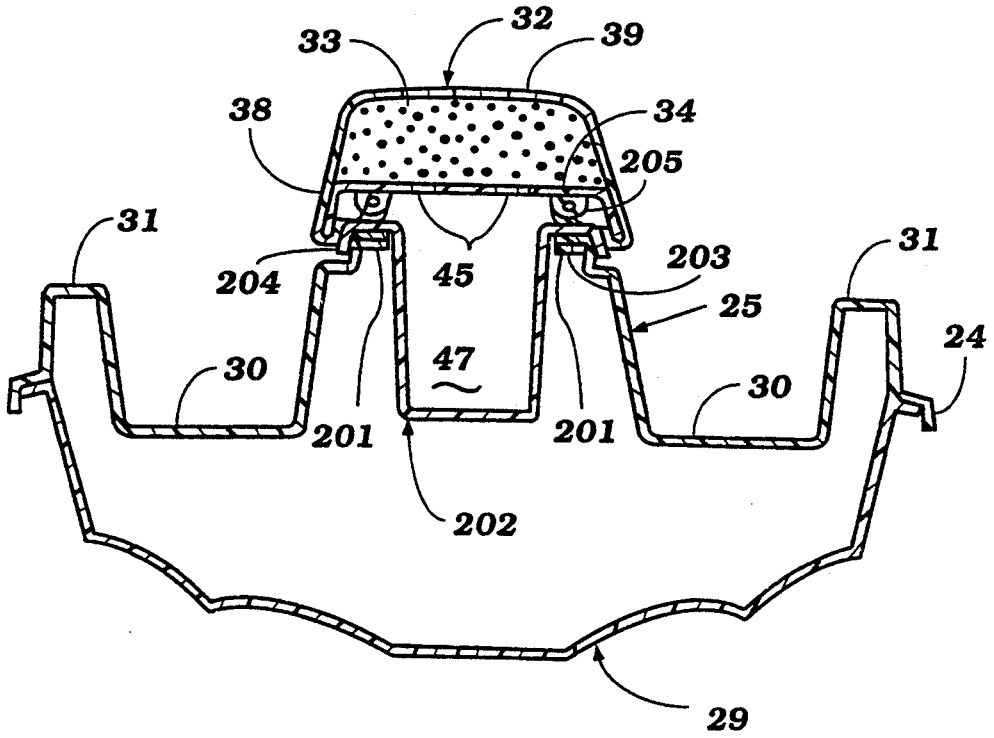
FIG. 10 is an enlarged cross sectional view taken along a plane perpendicular to the plane of FIG. 9.

In the embodiments of the invention as thus far described, not only has the cavity 47 been hermetically sealed but also the interior of the cushion material 33 was hermetically sealed additionally by the provision of the flexible bag 43 to receive the air which has been expelled from the cushion material when it has been compressed and to return the air to the cushion material 33 when it again expands. Although the provision of the additional hermetic sealing by the bag 43 is desirable, the bag 43 can be eliminated and FIGS. 9 and 10 show such an embodiment. This embodiment is basically the same at the embodiment of FIG. 8, however, the cavity 47 is not formed directly by the deck raised portion 25 but rather the deck raised portion 25 is provided with a central opening defined by an inwardly extending flange 201. An insert member 202 is inserted into this opening with a sealing gasket 203 being interposed therebetween. The insert member 202 has an outwardly extending flange 204 that engages the sealing gasket 203 and provides sealing. The seat assembly 32 is affixed in any suitable manner to the insert 202 and specifically its flange portion 204.

The air expelled when the cushioning material 33 will flow through the openings 45 and enter the sealed chamber 47. This air can return to the cushion when the cushioning material is no longer compressed as with the previously described embodiments. The chamber 47 is sealed by a sealing gasket 205 that is interposed between the bottom plate 34 of the seat cushion 32 and the flange 204 of the insert member 202.

In this embodiment, the jet propulsion unit appears and is identified by the reference numeral 206 with its impeller being indicated by the reference numeral 207. The engine compartment is defined forwardly of the area where the insert piece 202 is provided and is defined by a forward bulkhead 208 through which a driveshaft (not shown) extends for driving the impeller 207.

Figure 11:
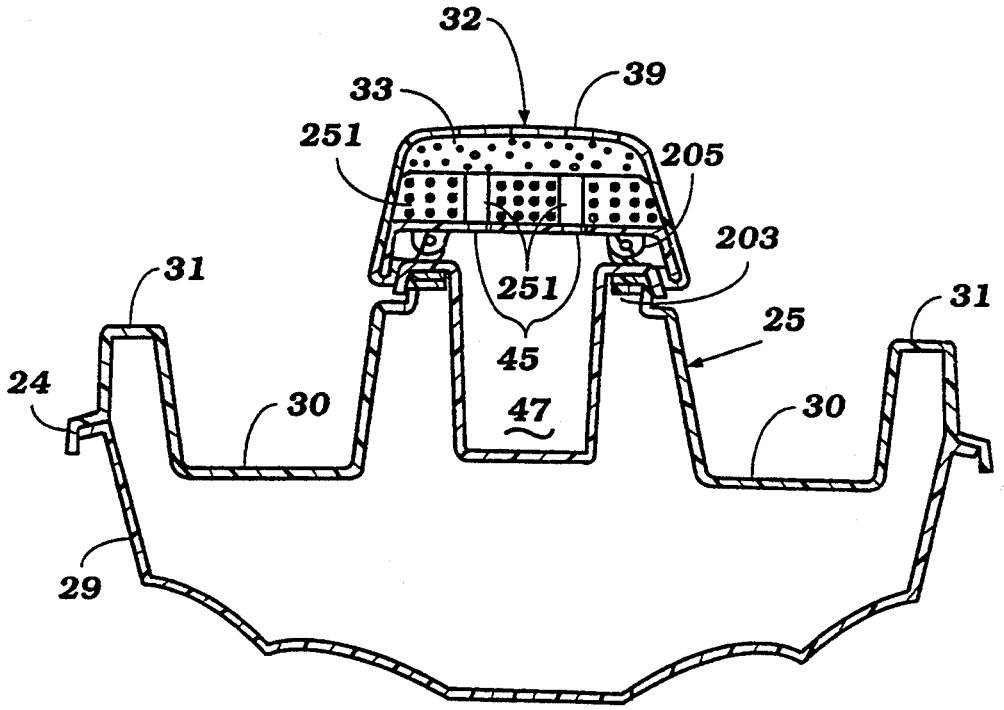
FIG. 11 is a cross sectional view, in part similar to FIG. 10, and shows another embodiment of the invention.

FIG. 11 shows another embodiment of the engine which is generally the same as the embodiment of FIGS. 9 and 10. However, in this embodiment, in addition to the open cell foam material 31 the seat is filled with a further closed cell foam material 251. This closed cell foam material 251 underlies the open cell foam material 33. To permit the air expelled from the open cells of the foam material 33 to the sealed cavity 47 there are provided holes 252 which are aligned with the holes 45 of the bottom plate 34.

It should be readily apparent from the foregoing description that the described embodiments of the invention provide seats for a watercraft that are well cushioned and which easily permits the air to flow in and out of the open cell cushioning material without having water being drawn into the cushion. Of course, the described embodiments are preferred embodiments of the invention and various changes and modifications may be made without departing from the spirit and scope of the invention as defined by the appended claims.

I claim:

1. A seat for a watercraft comprising a hull, said seat consisting of an open celled foam cushion defining a recess therein, a generally rigid bottom plate extending across a lower surface of said cushion and into said recess, a generally water impervious skin sealingly engaged around the periphery of said bottom plate and covering the portion of said cushion not covered by said bottom plate, means including said recess defining a cavity beneath said seat, means forming a hermetic seal between the periphery of said cavity and said bottom plate, and at least one air flow opening in the portion of said bottom plate which extend into said recess through which air may flow upon compression and expansion of said cushion.

2. A seat for a watercraft as set forth in claim 1 further including a flexible bag contained within the cavity and in communication with the air flow opening in the bottom plate to receive air expelled from the cushion upon its compression.

3. A seat for a watercraft as set forth in claim 2 wherein the cavity is generally elongated and extends substantially the full length and width of the bottom plate.

4. A seat for a watercraft as set forth in claim 3 wherein there are a plurality of air flow openings.

5. A seat for a watercraft as set forth in claim 2 wherein the cavity comprises a storage compartment for receiving articles in addition to the flexible bag.

6. A seat for a watercraft as set forth in claim 5 further including an access opening for accessing the storage compartment.

7. A seat for a watercraft as set forth in claim 6 wherein the cavity is generally elongated and extends substantially the full length and width of the bottom plate.

8. A seat for a watercraft as set forth in claim 7 wherein there are a plurality of air flow openings.

9. A seat for a watercraft as set forth in claim 3 wherein the cavity is formed by a closure plate affixed to the bottom plate.

10. A seat for a watercraft as set forth in claim 9 wherein there are a plurality of air flow openings.

11. A seat for a watercraft as set forth in claim 1 wherein the cavity is formed in part by the hull of the watercraft.

12. A seat for a Watercraft as set forth in claim 11 further including a flexible bag contained within the cavity and in communication with the air flow opening in the bottom plate to receive air expelled from the cushion upon its compression.

13. A seat for a watercraft as set forth in claim 12 wherein the cavity comprises a storage compartment for receiving articles in addition to the flexible bag.

14. A seat for a watercraft as set forth in claim 13 further including an access opening for accessing the storage compartment.

15. A seat for a watercraft as set forth in claim 1 further including a closed cell foam interposed between the open cell foam cushion and the bottom plate and having an opening aligned with the bottom plate air flow opening.

16. A seat for a watercraft as set forth in claim 15 wherein the cavity is formed in part by the hull of the watercraft.

17. A seat for a watercraft as set forth in claim 16 further including a flexible bag contained within the cavity and in communication with the air flow opening in the bottom plate to receive air expelled from the cushion upon its compression.

18. A seat for a watercraft as set forth in claim 17 wherein the cavity comprises a storage compartment for receiving articles in addition to the flexible bag.

19. A seat for a watercraft as set forth in claim 18 further including an access opening for accessing the storage compartment.

* * * * *